US009746218B2

(12) United States Patent
Sommer et al.

(10) Patent No.: US 9,746,218 B2
(45) Date of Patent: Aug. 29, 2017

(54) ECONOMIZED REFRIGERATION SYSTEM

(75) Inventors: Steven Trent Sommer, York, PA (US); Stephen Harold Smith, York, PA (US); John Francis Judge, Galena, OH (US)

(73) Assignee: Johnson Controls Technology Company, Holland, MI (US)

( * ) Notice: Subject to any disclaimer, the term of this patent is extended or adjusted under 35 U.S.C. 154(b) by 540 days.

(21) Appl. No.: 11/848,297

(22) Filed: Aug. 31, 2007

(65) Prior Publication Data

US 2008/0098754 A1 May 1, 2008

Related U.S. Application Data

(60) Provisional application No. 60/862,999, filed on Oct. 26, 2006.

(51) Int. Cl.
*F25B 41/00* (2006.01)
*F25B 49/00* (2006.01)
(Continued)

(52) U.S. Cl.
CPC ..... *F25B 41/00* (2013.01); *F25B 49/022* (2013.01); *F25B 1/04* (2013.01);
(Continued)

(58) Field of Classification Search
CPC ..... F25B 2400/075; F25B 2400/0751; F25B 2400/0409; F25B 2600/0209;
(Continued)

(56) References Cited

U.S. PATENT DOCUMENTS 2,277,647 A 3/1942 Jones
3,226,940 A 1/1966 Jekat et al.
(Continued)

FOREIGN PATENT DOCUMENTS

CH 227 856 A 7/1943
DE 43 09 137 A1 8/1994
(Continued)

OTHER PUBLICATIONS

Manske, K A et al., "Evaporator Condenser Control in Industrial Refrigeration Systems"; International Journal of Refrigeration, Jul. 2001, pp. 676-691, vol. 24, No. 7, Oxford, GB.
(Continued)

*Primary Examiner* — Marc Norman
*Assistant Examiner* — Daniel C Comings
(74) *Attorney, Agent, or Firm* — Fletcher Yoder, PC

(57) ABSTRACT

An economized refrigeration system includes a main refrigerant circuit having a condenser, an evaporator, an economizer, an expansion device intermediate the condenser and the economizer, and a main compressor fluidly connected by a main refrigerant line. The system also includes an economized refrigerant circuit including an auxiliary compressor system and an auxiliary refrigerant line fluidly connecting the economizer to the auxiliary compressor system and fluidly connecting the main refrigerant line to the auxiliary compressor at a location intermediate the main compressor system and the condenser. The auxiliary compressor system is independently controllable with respect to the main compressor system.

20 Claims, 5 Drawing Sheets

(51) Int. Cl.
*F25B 1/10* (2006.01)
*F25B 49/02* (2006.01)
*F25B 1/04* (2006.01)

(52) U.S. Cl.
CPC ..... *F25B 2400/0401* (2013.01); *F25B 2400/0409* (2013.01); *F25B 2400/075* (2013.01); *F25B 2400/0751* (2013.01); *F25B 2400/13* (2013.01); *F25B 2600/2509* (2013.01); *F25B 2600/2513* (2013.01)

(58) Field of Classification Search
CPC ..... F25B 2600/2513; F25B 2600/2509; F25B 2400/0401; F25B 2400/13; F24B 2400/06
USPC ..... 62/175, 196.1, 196.2, 196.4, 197, 198, 62/205, 222, 228.1, 228.5, 510, 113
See application file for complete search history.

(56) References Cited

U.S. PATENT DOCUMENTS 3,277,658 A 10/1966 Leonard, Jr.
3,367,125 A 2/1968 McGrath
3,553,974 A 1/1971 Osborne
3,580,006 A * 5/1971 Quick ..... 62/196.2
3,945,216 A * 3/1976 Schibbye ..... 62/84
3,976,458 A 8/1976 Krug
4,141,708 A 2/1979 Lavigne, Jr. et al.
4,144,717 A 3/1979 Andersen et al.
4,171,623 A 10/1979 Lavigne, Jr. et al.
4,232,533 A 11/1980 Lungblad et al.
4,332,144 A 6/1982 Shaw
4,899,555 A * 2/1990 Shaw ..... 62/505
5,094,085 A 3/1992 Irino
5,095,712 A 3/1992 Narreau
5,174,123 A * 12/1992 Erickson ..... 62/113
5,611,216 A 3/1997 Low et al.
5,669,234 A 9/1997 Houser et al.
6,158,240 A 12/2000 Low et al.
6,202,438 B1 3/2001 Barito
6,289,692 B1 9/2001 Houser et al.
6,474,087 B1 11/2002 Lifson
6,640,586 B1 11/2003 Baudat et al.
6,658,867 B1 12/2003 Taras et al.
6,691,531 B1 2/2004 Martinez et al.
6,722,157 B1 4/2004 Eaton et al.
6,820,434 B1 * 11/2004 Gutheim et al. ..... 62/175
6,928,828 B1 8/2005 Taras et al.
6,955,058 B2 10/2005 Taras et al.
6,973,797 B2 12/2005 Nemit, Jr.
7,075,268 B2 * 7/2006 Wills et al. ..... 318/812
7,628,027 B2 * 12/2009 Shapiro ..... 62/228.1
2004/0050090 A1 3/2004 Ophir et al.
2004/0237549 A1 * 12/2004 Okawara et al. ..... 62/228.1
2005/0262859 A1 * 12/2005 Crane ..... F25B 49/025 62/197
2006/0090502 A1 5/2006 Tara et al.
2006/0225445 A1 10/2006 Lifson
2007/0017240 A1 * 1/2007 Shapiro ..... F25B 1/10 62/228.1
2009/0071177 A1 * 3/2009 Unezaki ..... F25B 13/00 62/196.1

FOREIGN PATENT DOCUMENTS

GB 2 232 473 A 12/1990
JP 60 226669 A 11/1985
JP 63212797 A 9/1988
JP 10170083 A 6/1998
JP 2005061784 A 3/2005
TW I286877 9/2007

OTHER PUBLICATIONS

J. Dieckmann and J. Brodrick, "What's Easiest Is Not Always Best", ASHRAE Journal, Sep. 2009, pp. 84-88, vol. 51, No. 9.

* cited by examiner

ECONOMIZED REFRIGERATION SYSTEM

CROSS-REFERENCE TO RELATED PATENT APPLICATIONS

This application claims priority to U.S. Provisional Patent Application No. 60/862,999, filed Oct. 26, 2006, which is hereby incorporated by reference in its entirety.

BACKGROUND

The application generally relates to an economized refrigeration system. The application more specifically relates to an economized refrigeration system having an auxiliary compressor dedicated to economizer flow.

In refrigeration systems, a refrigerant gas is compressed by a compressor and passed to a condenser where it exchanges heat with another fluid such as the ambient air. From the condenser, the pressurized liquid refrigerant passes through an expansion device and then to an evaporator, where it exchanges heat with another fluid that is used to cool an environment. The refrigerant returns to the compressor from the evaporator and the cycle is repeated.

Economizer circuits are utilized in refrigeration systems to provide increased cooling capacity for a given evaporator size, and also to increase efficiency and performance of the system. An economizer circuit utilizing one or more additional expansion devices is sometimes incorporated just downstream of the condenser. For a system utilizing one additional expansion device, the primary expansion device expands the refrigerant from condenser pressure to an intermediate pressure, resulting in flashing of some of the refrigerant to its vapor state. The flashed refrigerant is reintroduced into the compression stage and provides some cooling during compression as the saturated vapor is mixed with the superheated vapor refrigerant. Cooling during compression results in some reduction to compressor input power. The remaining liquid refrigerant at the intermediate pressure from the primary expansion device is at a lower enthalpy. The additional expansion device expands the lower enthalpy liquid refrigerant from the intermediate pressure to evaporator pressure. The refrigerant enters the evaporator with lower enthalpy, thereby increasing the cooling effect in refrigerant systems with economized circuits versus non-economized systems in which the refrigerant is expanded directly from the condenser.

One traditional method of enabling an economized refrigeration system is through the use of a flash tank and an additional expansion device. In flash tank economizer circuits, the primary expansion device is provided upstream of the flash tank. Liquid refrigerant flows through the primary expansion device and into the flash tank. Upon passing through the primary expansion device, the liquid refrigerant experiences a substantial pressure drop, whereupon, at least a portion of the refrigerant rapidly expands or "flashes" and is converted from a liquid phase to a vapor phase at an intermediate pressure. The remaining liquid refrigerant gathers at the bottom of the tank for return to the main refrigerant line upstream of the additional expansion device. Vapor refrigerant is returned to the compressor, either at the compressor suction or to an intermediate stage of compression. As a result of the intermediate pressure of refrigerant gas in the flash tank, the gas returned to the compressor requires less compression, thereby increasing overall system efficiency.

Introducing the gas refrigerant from a flash tank economizer to one of the intermediate pressure compressor suctions or other stage in multi-stage compressors can be problematic. Typically, the first stage compressor handles the flow from the evaporator while a higher stage compressor handles the flow from the first stage compressor discharge as well as the flow from the economizer. In this arrangement, the economizer operating conditions are dictated by the overall system conditions and operating point; no method is available to independently control the economizer operating pressure and flow rate. Without such independent control, the economizer and second stage compressor must be designed for specific operating conditions. Off-design operating conditions result in a compromise in economizer performance, and consequently in overall system performance. In addition, this system requires multiple compression stages in series between the evaporator and condenser to incorporate the economizer.

Even more difficult is introducing the gaseous refrigerant from the economizer in systems having only single-stage compressors because there is no mechanical means to operate the compressor at a pressure level between the evaporator and condenser. Thus, the economizer operating conditions are dictated by the overall system conditions and operating point.

Intended advantages of the disclosed systems and/or methods satisfy one or more of these needs or provide other advantageous features. Other features and advantages will be made apparent from the present specification. The teachings disclosed extend to those embodiments that fall within the scope of the claims, regardless of whether they accomplish one or more of the aforementioned needs.

SUMMARY OF THE INVENTION

One embodiment relates to a refrigeration system that includes a condenser, an evaporator, an economizer, an expansion device intermediate the condenser and the economizer, and a main compressor fluidly connected by a main refrigerant line to form a main refrigerant circuit. The system also includes an auxiliary compressor and an auxiliary refrigerant line fluidly connecting the economizer to the auxiliary compressor and fluidly connecting the auxiliary compressor to the main refrigerant line at a location intermediate the main compressor and the condenser to form an economizer refrigerant circuit. The auxiliary compressor is independently controllable with respect to the main compressor.

Another embodiment relates to a method of operating an economized refrigeration system. The economized refrigeration system is provided that includes a condenser, an evaporator, an economizer, an expansion device intermediate the condenser and the economizer, and a main compressor fluidly connected by a main refrigerant line to form a main refrigerant circuit. The economized refrigeration system also includes an auxiliary compressor and an auxiliary refrigerant line fluidly connecting the economizer to the auxiliary compressor and fluidly connecting the auxiliary compressor to the main refrigerant line at a location intermediate the main compressor system and the condenser to form an economizer refrigerant circuit. The method further includes selecting an economizer operating pressure, operating the economizer at the selected operating pressure, controlling a flow rate of refrigerant passing through the auxiliary compressor independently from a flow rate of refrigerant passing through the main compressor, and controlling a rise in pressure across the auxiliary compressor independently from a rise in pressure across the main compressor.

Certain advantages of exemplary embodiments include that the economizer pressure can be controlled independently of overall system operating conditions, and the economizer pressure can be maintained at an optimal operating pressure. Certain other advantages include that the economizer circuit includes an auxiliary compressor dedicated to compressing refrigerant gas leaving the economizer, which auxiliary compressor can be controlled independently of the main compressor in the refrigeration system and that compressor types disfavored in conventional economized refrigeration systems can be used.

Alternative exemplary embodiments relate to other features and combinations of features as may be generally recited in the claims.

BRIEF DESCRIPTION OF THE FIGURES

Where like parts appear in multiple figures, it has been attempted to use like reference numerals.

DETAILED DESCRIPTION OF EXEMPLARY EMBODIMENTS

An economized refrigeration system includes two compressor systems: a main compressor to handle refrigerant flow through a main refrigeration circuit and an auxiliary compressor to compress gaseous refrigerant leaving the economizer to condenser pressure. By using an auxiliary compressor, the auxiliary compressor can be controlled independently from the main compressor. The discharge pressure of the auxiliary compressor can be matched with the discharge pressure of the refrigerant leaving the main compressor.

Figure 1:
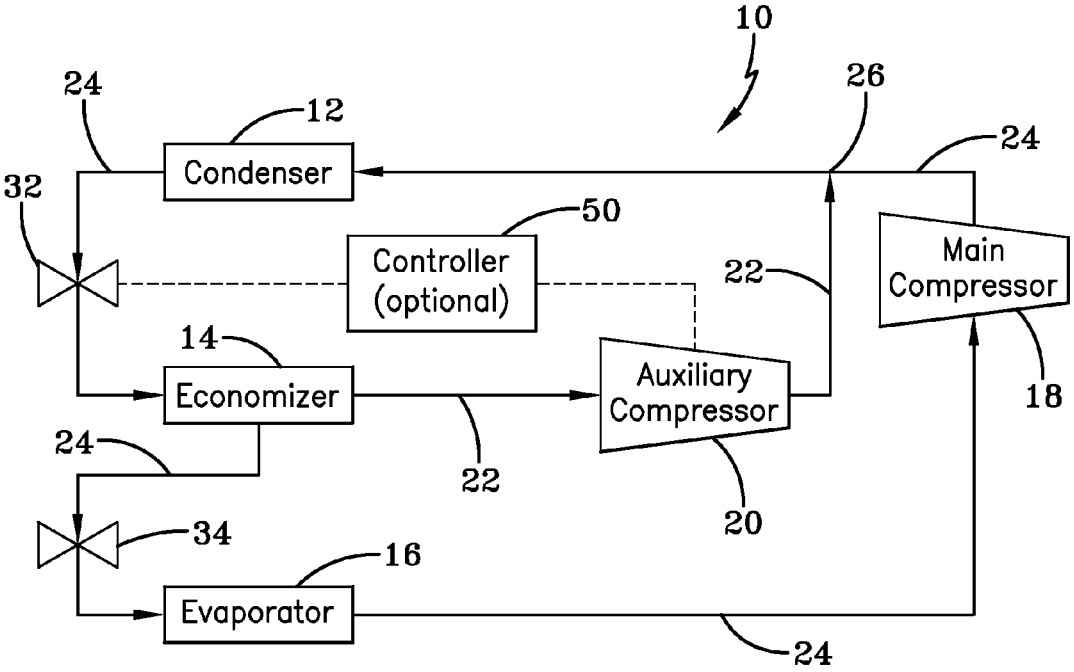
FIG. 1 illustrates one embodiment of an economized refrigeration system.
Figure 3:
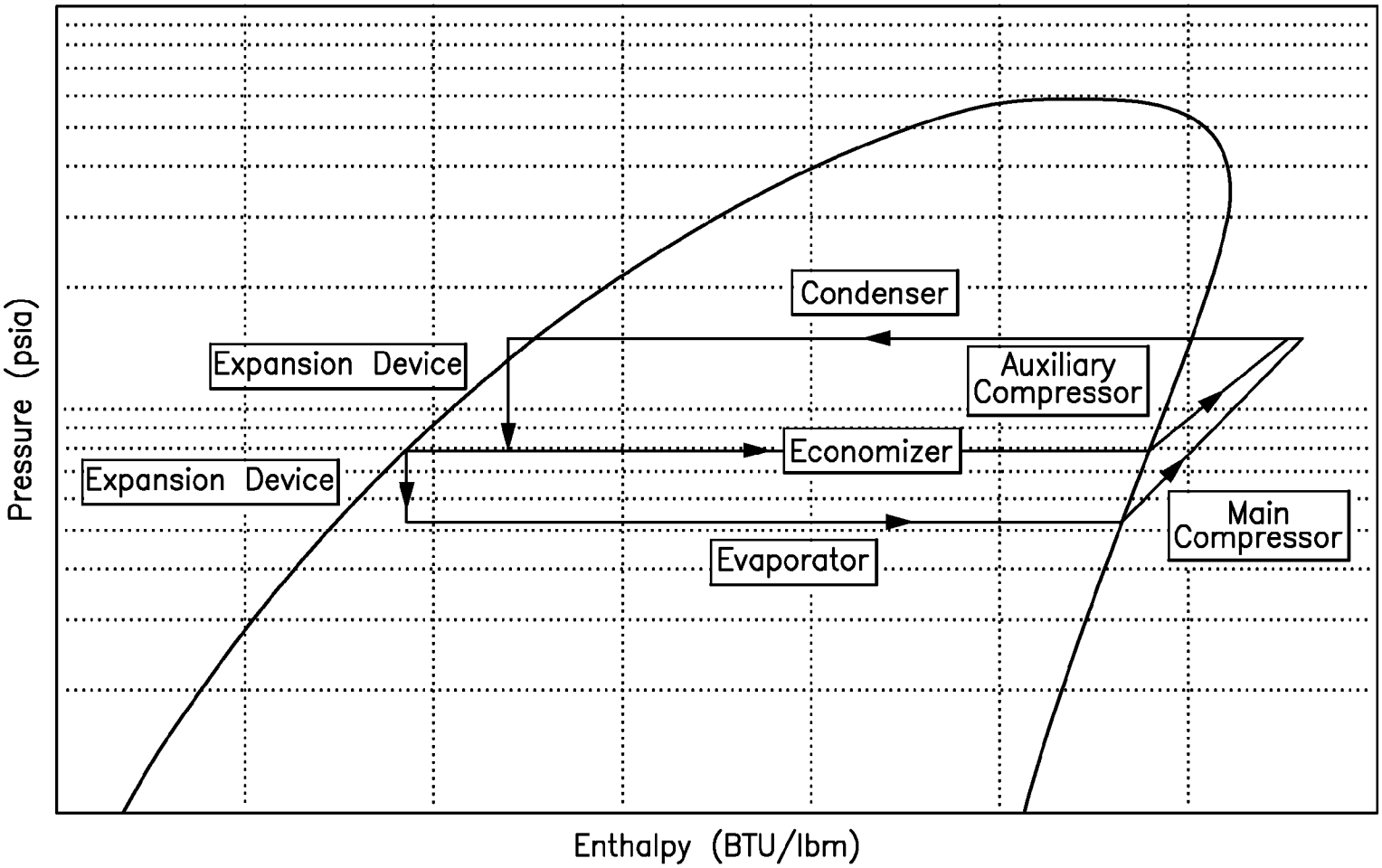
FIG. 3 is a qualitative pressure-enthalpy diagram for an economized refrigeration system.

FIG. 1 schematically illustrates an economized refrigeration system 10. As shown, system 10 starts at a condenser 12 in which high pressure gaseous refrigerant is cooled and condensed into high pressure liquid refrigerant. Optionally, the condenser 12 may also be used for sub-cooling, as shown in FIG. 3, which qualitatively illustrates a pressure-enthalpy diagram of an economized refrigeration system.

Condenser 12 is fluidly connected to an economizer 14 by a main refrigerant line 24. The economizer 14 can be any type of heat exchanger or other device in which a portion of the refrigerant is vaporized. In one embodiment, the economizer 24 is a flash tank. Along the main refrigerant line 24, intermediate the condenser 12 and the economizer 14, is a first expansion device 32. First expansion device 32 can be used to adjust the operating pressure of economizer 14.

Main refrigerant line 24 connects economizer 14 to an evaporator 16. Liquid refrigerant exits economizer 14 and enters evaporator 16 via main refrigerant line 24. A second expansion device 34 on main refrigerant line 24 is intermediate economizer 14 and evaporator 16. Any suitable expansion device may used for the first and second expansion devices 32, 34. In one embodiment, the expansion devices can be expansion valves. In evaporator 16, heat is exchanged between the liquid refrigerant and a fluid to be cooled. The heat transferred from the fluid to be cooled causes the liquid refrigerant to vaporize.

From evaporator 16, main refrigerant line 24 carries the now gaseous refrigerant to a main compressor 18. Main compressor 18 compresses the refrigerant flowing from evaporator 16 to a higher pressure and returns the compressed refrigerant gas to condenser 12 via main refrigerant line 24, completing a main refrigerant circuit of system 10. Main compressor 18 is a single-stage compressor. In one embodiment, main compressor 18 can be a single-stage centrifugal compressor, although any single-stage or multi-stage compressor could be used, such as a screw compressor, reciprocating compressor, or scroll compressor, by way of example only. In another embodiment, illustrated in FIG. 5, main compressor 18 comprises a bank of compressors 181, 182, 183. In one embodiment, the bank of compressors can include two or more single-stage compressors arranged in parallel, wherein each compressor can be independently controlled.

An auxiliary refrigerant line 22 is also fluidly connected to economizer 14. Auxiliary refrigerant line 22 carries gaseous refrigerant leaving economizer 14 to an auxiliary compressor 20 that is separate and distinct from main compressor 18 and can be dedicated to compressing refrigerant leaving economizer 14 via auxiliary refrigerant line 22. In one embodiment, auxiliary compressor 20 is a single auxiliary compressor, e.g., a screw compressor or a single-stage centrifugal compressor, although a bank of multiple compressors in parallel may be provided. However, like main compressor 18, any type of compressor having any number of stages could be used as auxiliary compressor 20. Auxiliary compressor 20 compresses gaseous refrigerant leaving the economizer 14 to a higher pressure, following which the compressed gaseous refrigerant is combined with the high pressure refrigerant leaving main compressor 18. From auxiliary compressor 20, auxiliary refrigerant line 22 connects back to main refrigerant line 24 at a common discharge location 26, which location can be at some point after main compressor 18 and prior to, or at, condenser 12, completing an economized refrigerant circuit of system 10.

Figure 2:
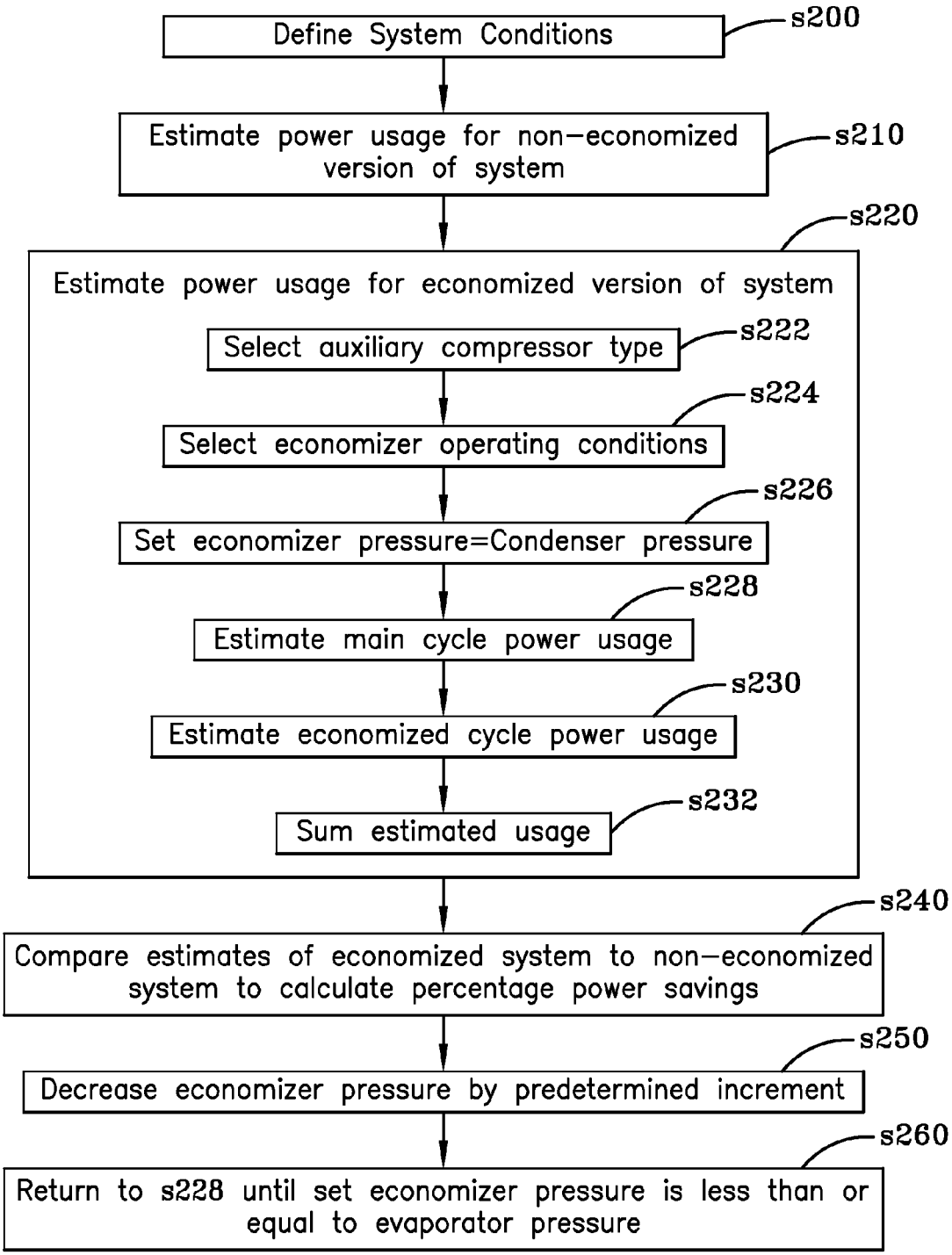
FIG. 2 is a flow chart illustrating one embodiment of a method for determining an economizer pressure.

Economizer 14 may be operated at any desired pressure. In one embodiment, economizer 14 is operated at a pressure within an optimal pressure range, which may be determined, for example, with reference to a net-power savings chart. A net-power savings determination can be made for a range of possible operating pressures ranging from a high that represents condenser pressure to a low that represents evaporator pressure. In one embodiment, an iterative process is used for determining the economizer pressure as illustrated in FIG. 2.

First, the overall system conditions for refrigeration system 10 are defined (s200). The overall system conditions may include the overall cooling capacity of the system, the operating pressures of the condenser and evaporator, and the main compressor type. Next, the power that would be used by that system 10, in the absence of an economizer circuit, is estimated (s210) using the previously defined system information, such as by reference to experimentally determined data or standard calculations. A baseline estimated power consumption can be established for later comparison against any estimated power savings accomplished by providing an economizer circuit.

Next, the power for the same system 10 having the overall conditions is estimated with the presence of an economizer circuit (s220). An auxiliary compressor type is selected (s222) and the economized circuit's operating conditions are defined (s224). For example, in one iterative calculation, operation under full load may be calculated, while other calculations may be performed with respect to a partial load. An economizer operating pressure is also selected (s226). In one embodiment of the iterative process, the economizer operating pressure can be selected equal to the condenser pressure.

The power used by the main circuit and the power used by the economizer circuit are both estimated (s228 and s230). The estimated values are summed (s232) and compared to the previously calculated baseline power estimation (s240) with respect to an non-economized version of the same system 10. Preferably, the power savings is calculated as a percentage of power saved. A new economizer operating pressure is then selected (s250) and the process returns to step s228 for a new estimation of the power used at the new selected economizer operating pressure. As illustrated, the original economizer operating pressure is set equal to the condenser pressure, then decreased in a pre-determined incremental amount (s250). The estimation process is repeated in an iterative fashion at different selected pressures until the incremental change results in calculations where the economizer operating pressure is equal to or less than the evaporator pressure (s260).

Figure 4:
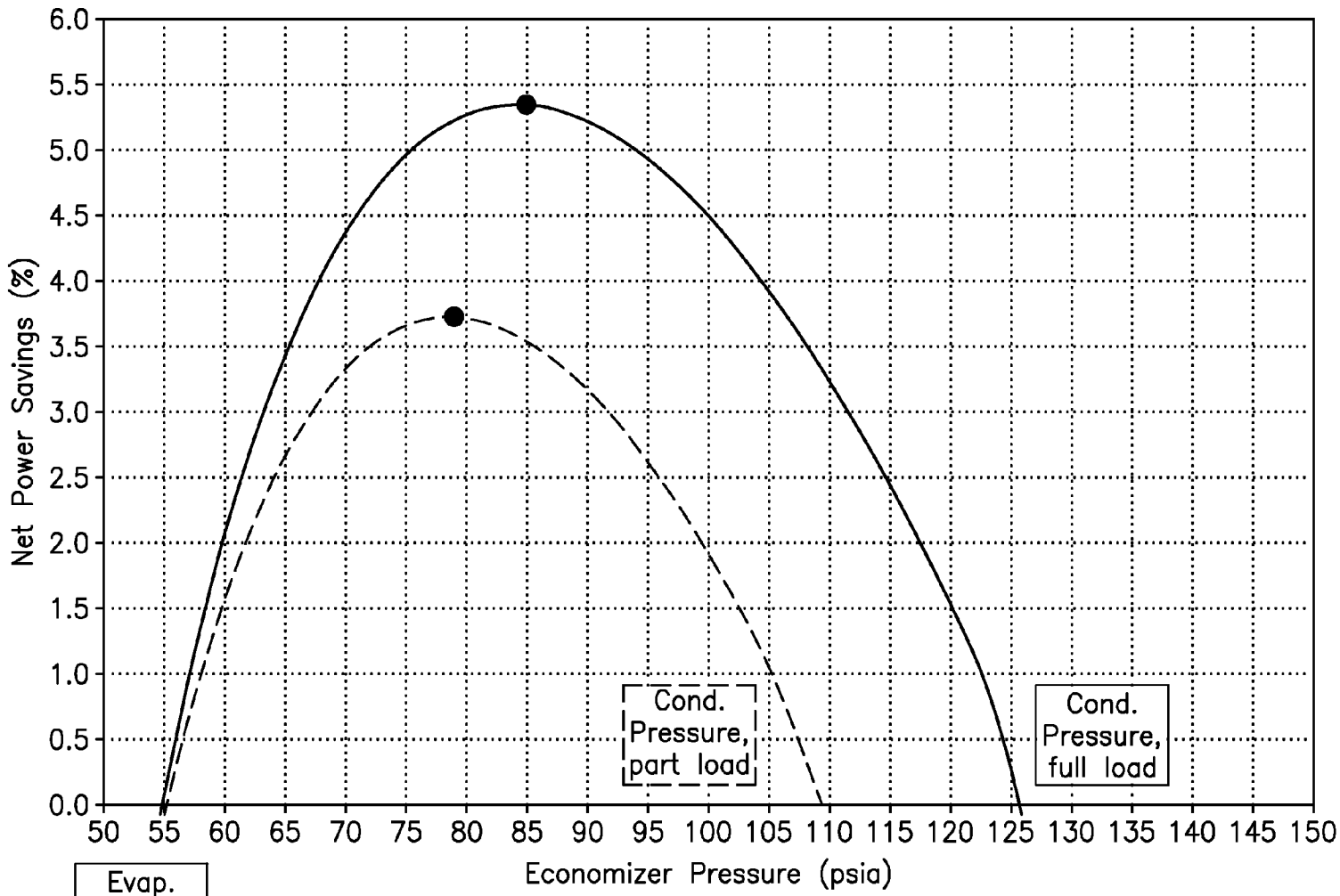
FIG. 4 is a power savings chart illustrating optimal performance characteristics achievable in controlling an economized refrigeration system.

The calculated percentage of power saved for each operating pressure can be plotted across the range of selected economizer operating pressures to yield a net power savings chart. An exemplary chart is shown in FIG. 4. The sample chart shown in FIG. 4 was prepared based on a refrigeration system having R134a refrigerant, an evaporation saturation temperature of 43 degrees F., a condenser saturation temperature of 104 degrees F., and 8 degrees of sub-cooling. Under these circumstances, with reference to the chart, it can be determined that optimized performance of the refrigeration system shown in FIG. 1 can be achieved when the economizer operates at a pressure of approximately 85 psia, as shown by the solid line which reflects the system under full load, or at approximately 79 psia, as shown by the dashed line, when the system is operating under partial load. Operating pressures below the y-axis indicate no net power savings can be achieved using an economizer and may be disregarded.

Thus, the power savings reflect the percentage of power saved by operating a refrigeration system 10 with an economizer circuit versus if the same system 10 were otherwise the same but did not include the economizer circuit. The net power savings can depend upon refrigerant type, the saturation temperatures in the condenser and the evaporator respectively, and whether the condenser includes any sub-cooling. The economizer pressure corresponding to the maximum net power savings is preferably the economizer operating pressure to be maintained by controlling first expansion device 32 and auxiliary compressor 20, and thus substantially maintaining economizer 14 at optimal operating conditions independent of changes that occur in other parts of refrigeration system 10.

Optimal economizer operating pressure ranges may depend on a number of factors, some of which are permanent or semi-permanent, such as the type of refrigerant and type of compressor and associated operating characteristics, while other factors vary based on the particular operating conditions or load experienced by the overall system. As a result, the net power savings may change as the load on the refrigeration system varies.

Because auxiliary compressor 20 is independently controllable with respect to main compressor 18, operation of the auxiliary compressor 20 in a manner that does not adversely affect performance of the main compressor 18 is permitted.

Adverse main compressor 18 performance may be avoided by controlling the lift of the auxiliary compressor 20 in order to match the discharge static pressures of the auxiliary compressor 20 and the main compressor 18 at the common discharge point 26. Adverse performance of the main compressor 18 may further be avoided by controlling the flow rate through the auxiliary compressor 20 so that only gaseous refrigerant flows through the economizer circuit. This reduces or avoids liquid carry-over in the economizer circuit by directing all liquid refrigerant to evaporator 16.

Lift and capacity of auxiliary compressor 20 can be controlled in any manner as is known to those of ordinary skill in the art with respect to the particular type of compressor selected as auxiliary compressor 20. For example, auxiliary compressor 20 may include a variable speed drive to control lift and capacity. Capacity may also be controlled using a hot gas bypass. Alternatively, multiple auxiliary compressors in parallel could be used to control capacity. If auxiliary compressor 20 is a screw compressor, a slide valve may be used to control capacity at a constant head. If auxiliary compressor 20 is a centrifugal compressor, control may be accomplished through prerotation vanes, suction throttling, and/or a variable geometry diffuser, by way of example only.

Figure 5:
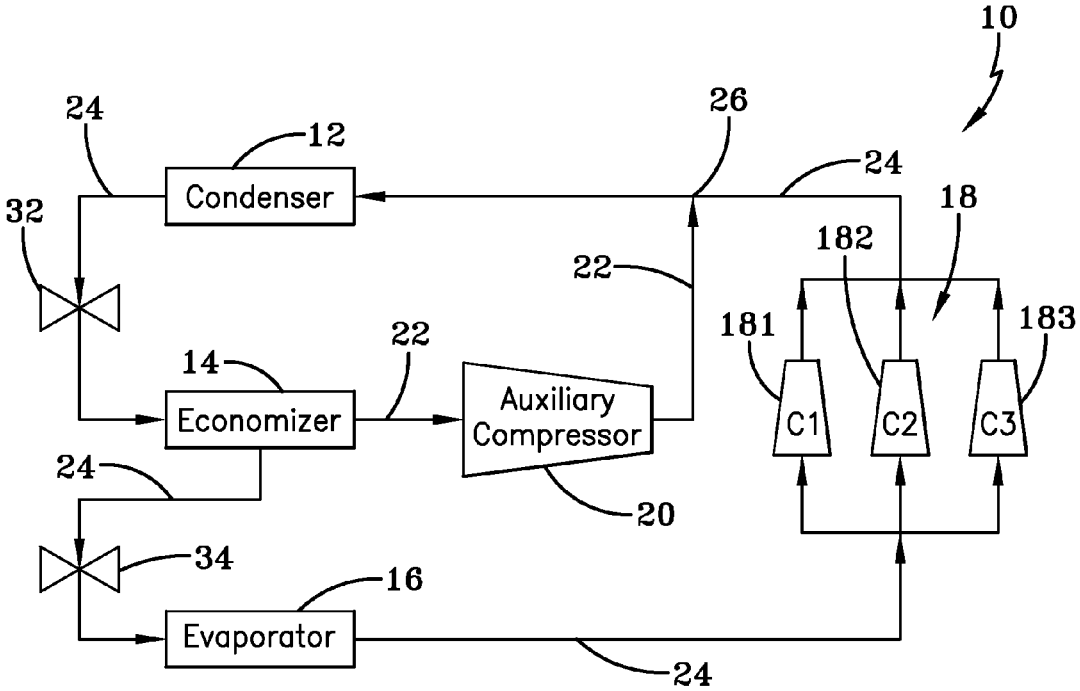
FIG. 5 illustrates another embodiment of an economized refrigeration system.
Figure 6:
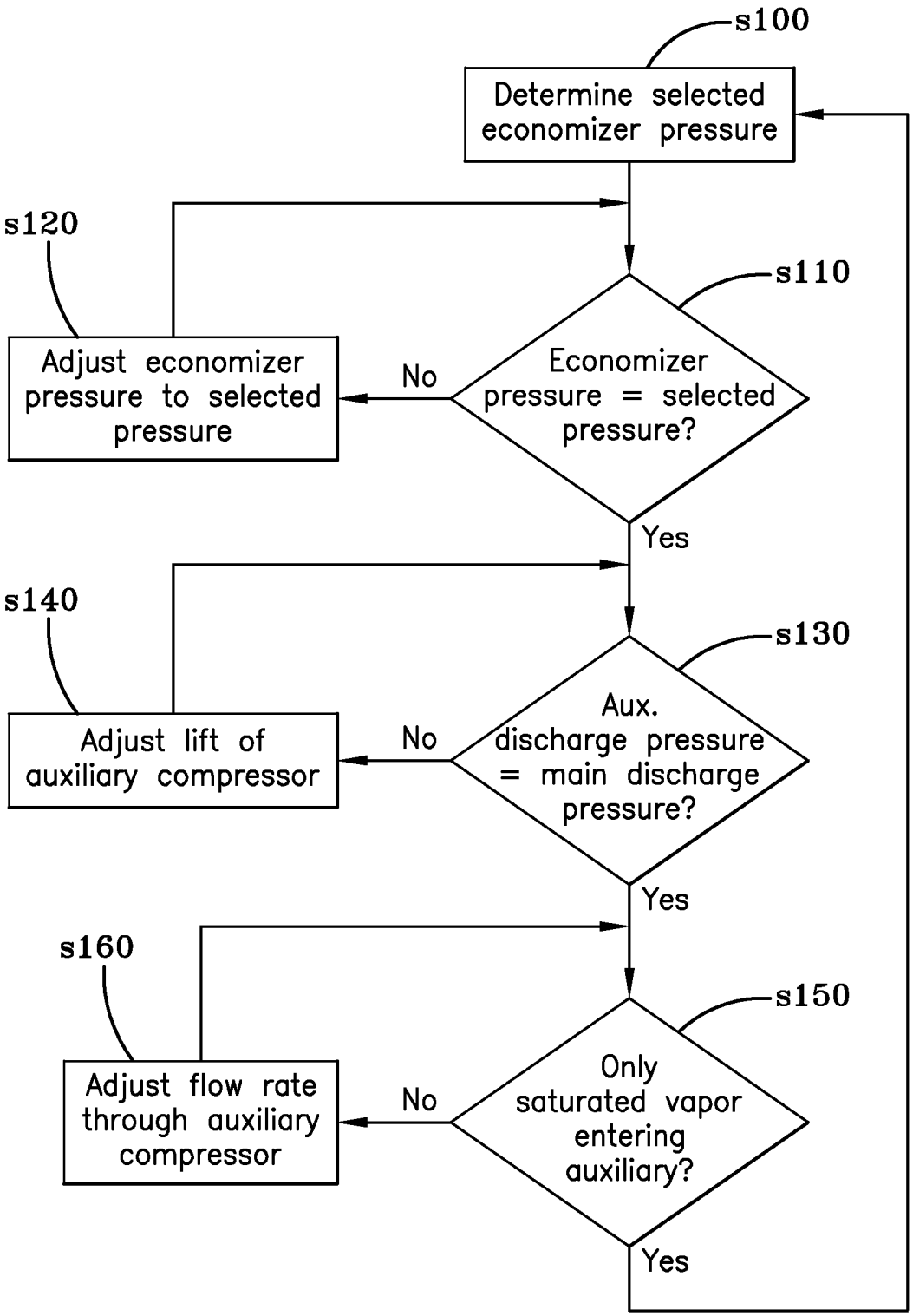
FIG. 6 is a flow chart illustrating one embodiment of a method of operating an economized refrigeration system.

FIG. 6 illustrates a method for operating an economized refrigeration system, such as the systems shown in either of FIGS. 1 or 5. An economizer operating pressure is selected (s100). Preferably, the operating pressure is within a range of optimal operating pressure selected with reference to the net power savings. Because net power savings is related to overall system conditions, the optimal economizer pressure may change during operation, such as depending on whether system 10 is operating under a full or partial load. Next, a determination is made whether the economizer pressure is equal to the selected optimal pressure (s110). It should be appreciated that by "equal" is meant equal to or within a predetermined range within which the pressures being compared are deemed to be equal to one another.

If the economizer pressure and the selected pressures are not equal, the economizer pressure is adjusted to the selected pressure (s120) by adjusting first expansion device 32, such as by opening or closing a valve to achieve the selected economizer operating pressure.

Once the economizer pressure is equal to the selected pressure, or if the economizer pressure is already equal to the optimal pressure, the discharge pressure of auxiliary compressor 20 is compared with the discharge pressure of main compressor 18 at common discharge point 26. If the two are not equal, a change is made in the lift of auxiliary compressor 20 (s140) until the two discharge pressures are equal at common discharge point 26.

If, at common discharge point 26, the pressures of the auxiliary compressor discharge and the main compressor discharge are equal, a determination is made whether only saturated vapor from the economizer is entering the auxiliary compressor 20 (s150). If not, the flow rate is adjusted, for example, by increasing or decreasing the speed of the motor of the auxiliary compressor 20.

Although illustrated in a particular order in FIG. 6, it should be appreciated that inquiries of steps s130 and s150, and the appropriate adjustments associated therewith, may be performed in any order or simultaneously.

In one embodiment, an optional controller 50 (FIG. 1) is provided in electronic communication with auxiliary compressor 20 and with first expansion device 32 to provide automated control. Controller 50 is also in one-way communication with a plurality of sensors positioned throughout refrigeration system 10 to monitor changes in pressure, flow rate, and any other properties desired to be monitored. Controller 50 includes at least a microprocessor and a memory. The microprocessor is configured such that in response to measured changes in refrigeration system 10, controller 50 sends control signals to first expansion device 32 to adjust the economizer operating pressure to the selected operating pressure. Controller 50 may further send control signals to auxiliary compressor 20 that cause a change in either one or both of the auxiliary compressor's capacity or lift to maintain the selected operating conditions in economizer 14.

It should be understood that the application is not limited to the details or methodology set forth in the following description or illustrated in the figures. It should also be understood that the phraseology and terminology employed herein is for the purpose of description only and should not be regarded as limiting.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

The present application contemplates methods, systems and program products on any machine-readable media for accomplishing its operations. The embodiments of the present application may be implemented using an existing computer processors, or by a special purpose computer processor for an appropriate system, incorporated for this or another purpose or by a hardwired system.

It is important to note that the construction and arrangement of the refrigeration system as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

As noted above, embodiments within the scope of the present application include program products comprising machine-readable media for carrying or having machine-executable instructions or data structures stored thereon. Such machine-readable media can be any available media, which can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

It should be noted that although the figures herein may show a specific order of method steps, it is understood that the order of these steps may differ from what is depicted. Also two or more steps may be performed concurrently or with partial concurrence. Such variation will depend on the software and hardware systems chosen and on designer choice. It is understood that all such variations are within the scope of the application. Likewise, software implementations could be accomplished with standard programming techniques with rule based logic and other logic to accomplish the various connection steps, processing steps, comparison steps and decision steps.

What is claimed is:

1. A refrigeration system comprising:

a condenser, an evaporator, an economizer, and a main compressor fluidly connected by a main refrigerant line to form a main refrigerant circuit;

an expansion device connected to the main refrigerant line intermediate the condenser and the economizer;

an auxiliary compressor, the auxiliary compressor being separate and distinct from the main compressor and independently controllable at all times with respect to the main compressor, the auxiliary compressor being capable of being operated at a different speed than the main compressor;

an auxiliary refrigerant line fluidly connecting the economizer to the auxiliary compressor and fluidly connecting the auxiliary compressor to the main refrigerant line at a location intermediate the main compressor and the condenser to form an economizer refrigerant circuit, wherein the auxiliary compressor is configured to compress refrigerant flowing through the economizer refrigerant circuit; and a controller configured to adjust an economizer pressure based on a comparison of an estimated power usage of a version of the refrigeration system without the economizer and an estimated power usage of the refrigeration system with the economizer;

wherein the economizer is positioned at a junction between the main refrigerant line and the auxiliary refrigerant line, the junction in fluid communication with the main refrigerant line and the auxiliary refrigerant line;

wherein all refrigerant flowing in the main refrigerant line from the condenser flows through the expansion device and enters the economizer in a single flow prior to a first portion of the refrigerant entering the evaporator, and prior to a remaining portion of the refrigerant entering the auxiliary compressor, each of the first portion of the refrigerant and the remaining portion of the refrigerant being greater than zero at all times during operation of the system.

2. The refrigeration system of claim 1, wherein the auxiliary compressor is configured to discharge compressed refrigerant at a pressure substantially equal to a discharge pressure of the main compressor.

3. The refrigeration system of claim 1, wherein the main compressor comprises a single-stage compressor.

4. The refrigeration system of claim 3, wherein the main compressor comprises a centrifugal compressor.

5. The refrigeration system of claim 1, wherein the main compressor comprises a plurality of compressors connected in parallel.

6. The refrigeration system of claim 1, wherein the auxiliary compressor comprises a screw compressor.

7. The refrigeration system of claim 6, wherein the screw compressor has a slide valve and a variable speed drive.

8. The refrigeration system of claim 1, wherein the auxiliary compressor comprises centrifugal compressor.

9. The refrigeration system of claim 8, wherein the centrifugal compressor has a control feature selected from the group consisting of: a variable speed drive, prerotation vanes, suction throttling, a variable geometry diffuser, and combinations thereof.

10. The refrigeration system of claim 1, wherein the economizer comprises a flash tank.

11. The refrigeration system of claim 1, wherein the expansion device comprises a valve.

12. The refrigeration system of claim 1, wherein the controller is configured to control the expansion device and the auxiliary compressor in response to refrigeration system operating conditions.

13. The refrigeration system of claim 1 further comprising an additional expansion device intermediate the economizer and the evaporator.

14. A method for operating an economized refrigeration system comprising:

providing a main refrigerant circuit comprising a condenser, an evaporator, an economizer, an expansion device intermediate the condenser and the economizer, and a main compressor fluidly connected by a main refrigerant line;

providing an economizer refrigerant circuit comprising an auxiliary compressor that is separate and distinct from the main compressor and an auxiliary refrigerant line fluidly connecting the economizer to the auxiliary compressor system and fluidly connecting the auxiliary compressor to the main refrigerant line at a location intermediate the main compressor and the condenser, the auxiliary compressor being capable of being operated at a different speed than the main compressor, wherein the economizer is positioned at a junction between the main refrigerant line and the auxiliary refrigerant line, the junction in fluid communication with the main refrigerant line and the auxiliary refrigerant line, wherein all refrigerant flowing in the main refrigerant line from the condenser flows through the expansion device and enters the economizer in a single flow prior to a first portion of the refrigerant entering the evaporator, and prior to a remaining portion of the refrigerant entering the auxiliary compressor, each of the first portion of the refrigerant and the remaining portion of the refrigerant being greater than zero at all times during operation of the system;

selecting an economizer operating pressure, wherein selecting the economizer operating pressure comprises adjusting the economizer operating pressure based on a comparison of an estimated power usage of a version of the economized refrigeration system without the economizer and an estimated power usage of the economized refrigeration system with the economizer;

operating the economizer at the selected operating pressure independent of changes in the main refrigerant circuit;

controlling a flow rate of refrigerant passing through the auxiliary compressor independently at all times from a flow rate of refrigerant passing through the main compressor; and controlling a rise in pressure across the auxiliary compressor independently from a rise in pressure across the main compressor based on the selected operating pressure.

15. The method of claim 14 wherein the step of operating the economizer at the selected operating pressure comprises adjusting the expansion device to modify the economizer operating pressure to the selected operating pressure.

16. The method of claim 14 wherein the step of selecting an economizer operating pressure further comprises selecting an economizer operating pressure greater than or equal to evaporator pressure.

17. The method of claim 14 wherein the step of controlling a rise in pressure across the auxiliary compressor comprises:

establishing a common discharge location for intermixing refrigerant compressed by the main compressor and refrigerant compressed by the auxiliary compressor;

determining a pressure of refrigerant compressed by the main compressor at the common discharge location;

determining a pressure of refrigerant compressed by the auxiliary compressor at the common discharge location;

adjusting the rise in pressure across the auxiliary compressor; and discharging refrigerant from the auxiliary compressor at the common discharge location at a pressure substantially equal to the discharge pressure of the main compressor.

18. The method of claim 14 wherein the step of controlling a flow rate of refrigerant passing through the auxiliary compressor comprises modifying the flow rate to compress only gaseous refrigerant from the economizer in the auxiliary compressor.

19. The method of claim 18 wherein the step of controlling a flow rate of refrigerant passing through the auxiliary compressor comprises modifying the flow rate to compress only saturated gaseous refrigerant from the economizer in the auxiliary compressor.

20. An economized refrigeration system comprising:

a condenser, an evaporator, an economizer, and a main compressor fluidly connected by a main refrigerant line to form a main refrigerant circuit, the main compressor consisting of a single-stage centrifugal compressor;

an expansion device connected to the main refrigerant line intermediate the condenser and the economizer;

an auxiliary compressor, the auxiliary compressor being separate and distinct, and independently controllable with respect to the main compressor, the auxiliary compressor being capable of being operated at a different speed than the main compressor;

an auxiliary refrigerant line fluidly connecting the economizer to the auxiliary compressor and fluidly connecting the auxiliary compressor to the main refrigerant line at a location intermediate the main compressor and the condenser to form an economizer refrigerant circuit, wherein the auxiliary compressor is configured to compress refrigerant flowing through the economizer refrigerant circuit; and a controller configured to adjust an economizer pressure based on a comparison of an estimated power usage of a version of the economized refrigeration system without the economizer and an estimated power usage of the economized refrigeration system with the economizer;

wherein the economizer is positioned at a junction between the main refrigerant line and the auxiliary refrigerant line, the junction in fluid communication with the main refrigerant line and the auxiliary refrigerant line;

wherein all refrigerant flowing in the main refrigerant line from the condenser flows through the expansion valve and enters the economizer in a single flow prior to a first portion of the refrigerant entering the evaporator, and prior to a remaining portion of the refrigerant entering the auxiliary compressor, each of the first portion of the refrigerant and the remaining portion of the refrigerant being greater than zero at all times during operation of the system.

* * * * *